US011217900B2

(12) United States Patent
Lin et al.

(10) Patent No.: US 11,217,900 B2
(45) Date of Patent: Jan. 4, 2022

(54) ANTENNA STRUCTURE AND WIRELESS COMMUNICATION DEVICE USING THE SAME

(71) Applicant: Shenzhen Next Generation Communications Limited, Shenzhen (CN)

(72) Inventors: Zheng Lin, Shenzhen (CN); Yi-Ming Chen, New Taipei (TW); Chih-Chung Hsieh, New Taipei (TW); Ke-Jia Lin, Shenzhen (CN); Kuo-Cheng Chen, New Taipei (TW)

(73) Assignee: Mobile Drive Netherlands B.V., Amsterdam (NL)

( * ) Notice: Subject to any disclaimer, the term of this patent is extended or adjusted under 35 U.S.C. 154(b) by 145 days.

(21) Appl. No.: 16/656,192

(22) Filed: Oct. 17, 2019

(65) Prior Publication Data

US 2020/0161773 A1 May 21, 2020

(30) Foreign Application Priority Data

Nov. 16, 2018 (CN) ..... 201811368882.1

(51) Int. Cl.

| | |
|---|---|
| ***H01Q 21/06*** | (2006.01) |
| ***H01Q 1/48*** | (2006.01) |
| ***H01Q 15/02*** | (2006.01) |
| ***H01Q 19/06*** | (2006.01) |
| ***H01Q 9/04*** | (2006.01) |

(Continued)

(52) U.S. Cl.

CPC ..... *H01Q 21/061* (2013.01); *H01Q 1/48* (2013.01); *H01Q 1/523* (2013.01); *H01Q 9/045* (2013.01); *H01Q 15/02* (2013.01); *H01Q 19/06* (2013.01); *H01Q 21/065* (2013.01); *H01Q 1/241* (2013.01)

(58) Field of Classification Search

CPC ..... H01Q 21/065; H01Q 9/0407

See application file for complete search history.

(56) References Cited

U.S. PATENT DOCUMENTS

| | | | | |
|---|---|---|---|---|
| 8,213,757 | B2 * | 7/2012 | Harrysson ..... | H01Q 1/38 385/120 |
| 10,483,650 | B1 | 11/2019 | Zimmerman et al. | |
| 10,826,196 | B1 * | 11/2020 | Rogers ..... | H01Q 13/085 |

(Continued)

FOREIGN PATENT DOCUMENTS

| | | | |
|---|---|---|---|
| CN | 1941503 | A | 4/2007 |
| CN | 104505581 | A | 4/2015 |

(Continued)

*Primary Examiner* — Ab Salam Alkassim, Jr.
(74) *Attorney, Agent, or Firm* — ScienBiziP, P.C.

(57) ABSTRACT

An antenna structure suitable for 5G use in controlling direction of radio beams and in increasing antenna gain includes a substrate, an array of antennas, a main body, a lens array, a grounding plate, and a high-impedance surface (HIS) layer embedded into the substrate. The array of antenna units is positioned on the substrate surface under the protection of the main body. The lens array includes a lens units for each antenna unit, the lens units concentrate the beams generated by the antenna units. The grounding plate is underneath and grounds the antenna units. The HIS layer suppresses surface waves generated by the lens arrays and the substrate and increases a gain of the antenna structure in certain directions.

18 Claims, 8 Drawing Sheets

(51) Int. Cl.
*H01Q 1/52* (2006.01)
*H01Q 1/24* (2006.01)

(56) References Cited

U.S. PATENT DOCUMENTS

| | | | | |
|---|---|---|---|---|
| 10,992,055 | B2 * | 4/2021 | Hunziker | H01Q 1/40 |
| 2003/0010529 | A1 * | 1/2003 | Sievenpiper | H01Q 15/14 174/255 |
| 2004/0174315 | A1 * | 9/2004 | Miyata | H01Q 19/062 343/770 |
| 2005/0200531 | A1 * | 9/2005 | Huang | H01Q 21/0006 343/700 MS |
| 2009/0079637 | A1 * | 3/2009 | Fukui | H01Q 11/04 343/700 MS |
| 2010/0309089 | A1 * | 12/2010 | Collinson | H01Q 1/42 343/872 |
| 2011/0215976 | A1 | 9/2011 | Clymer et al. | |
| 2012/0019423 | A1 * | 1/2012 | Schultheiss | H01Q 21/065 343/753 |
| 2012/0299797 | A1 | 11/2012 | Murdock et al. | |
| 2014/0132473 | A1 * | 5/2014 | Isom | H01Q 21/0006 343/855 |
| 2016/0351996 | A1 * | 12/2016 | Ou | H01Q 21/065 |
| 2017/0062944 | A1 * | 3/2017 | Zimmerman | H01Q 1/246 |
| 2017/0346177 | A1 * | 11/2017 | Nagata | G01S 13/931 |
| 2018/0115087 | A1 * | 4/2018 | Besoli | H01Q 21/065 |
| 2019/0051989 | A1 * | 2/2019 | Kim | H01Q 15/08 |
| 2019/0310345 | A1 * | 10/2019 | Nagaishi | H01Q 19/08 |
| 2019/0363456 | A1 * | 11/2019 | Chen | H01Q 1/2258 |
| 2020/0099127 | A1 * | 3/2020 | Rogers | H01Q 1/287 |
| 2020/0227827 | A1 * | 7/2020 | Vollmer | H01Q 21/061 |
| 2020/0251826 | A1 * | 8/2020 | Onaka | H01L 23/66 |
| 2020/0412022 | A1 * | 12/2020 | Yun | H01Q 9/045 |
| 2021/0044011 | A1 * | 2/2021 | Liu | H01Q 1/22 |
| 2021/0218142 | A1 * | 7/2021 | Yoshikawa | H01Q 5/378 |

FOREIGN PATENT DOCUMENTS

| | | | |
|---|---|---|---|
| CN | 107046183 | A * | 8/2017 |
| CN | 107046183 | A | 8/2017 |
| CN | 107949955 | A | 4/2018 |

* cited by examiner

ANTENNA STRUCTURE AND WIRELESS COMMUNICATION DEVICE USING THE SAME

FIELD

The subject matter herein generally relates to antennas.

BACKGROUND

In the 5G standard, a working wavelength of the millimeter-scale wave antenna is short and a transmission loss of the electromagnetic wave is large. An array of antennas is required to obtain a high gain antenna and to control a direction of beam. The limited internal space of a communication device limits a number and an area size of the array of antennas.

Therefore, there is room for improvement within the art.

BRIEF DESCRIPTION OF THE DRAWINGS

Implementations of the present disclosure will now be described, by way of embodiment, with reference to the attached figures.

DETAILED DESCRIPTION

Figure 1:
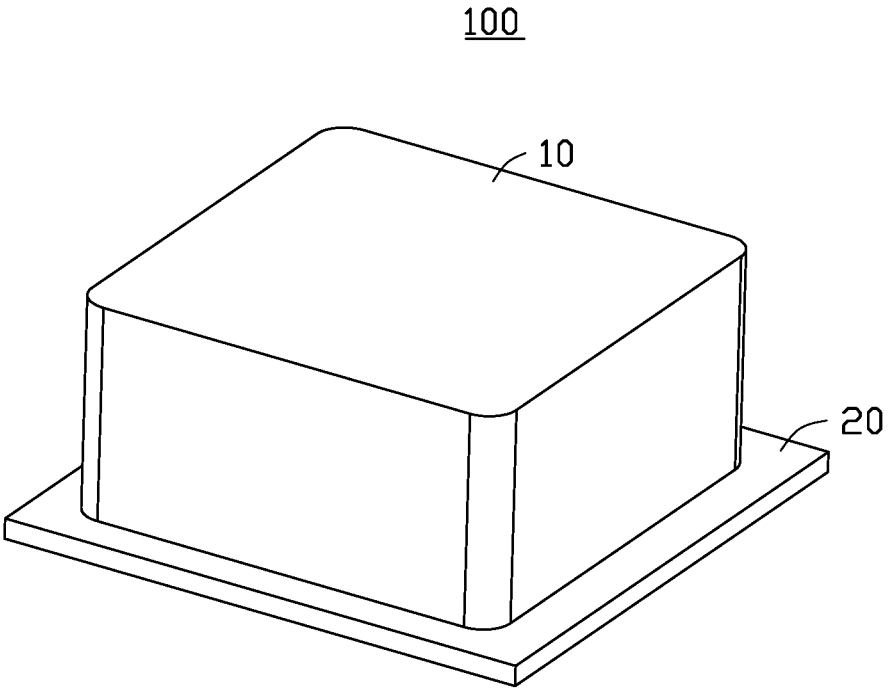
FIG. 1 is an isometric view of an embodiment of an antenna structure.

It will be appreciated that for simplicity and clarity of illustration, where appropriate, reference numerals have been repeated among the different figures to indicate corresponding or analogous elements. In addition, numerous specific details are set forth in order to provide a thorough understanding of the embodiments described herein. However, it will be understood by those of ordinary skill in the art that the embodiments described herein can be practiced without these specific details. In other instances, methods, procedures, and components have not been described in detail so as not to obscure the related relevant feature being described. Also, the description is not to be considered as limiting the scope of the embodiments described herein. The drawings are not necessarily to scale and the proportions of certain parts have been exaggerated to better illustrate details and features of the present disclosure.

Several definitions that apply throughout this disclosure will now be presented.

The term "substantially" is defined to be essentially conforming to the particular dimension, shape, or other feature that the term modifies, such that the component need not be exact. For example, "substantially cylindrical" means that the object resembles a cylinder, but can have one or more deviations from a true cylinder. The term "comprising" when utilized, means "including, but not necessarily limited to"; it specifically indicates open-ended inclusion or membership in the so-described combination, group, series, and the like.

The present disclosure is described in relation to an antenna structure and a wireless communication device using the same.

FIG. 1 illustrates an embodiment of antenna structure 100 used in a wireless communication device. The antenna structure 100 is configured for receiving and transmitting wireless signals. The wireless communication device can be, for example, a mobile phone or a personal digital assistant.

Figure 2:
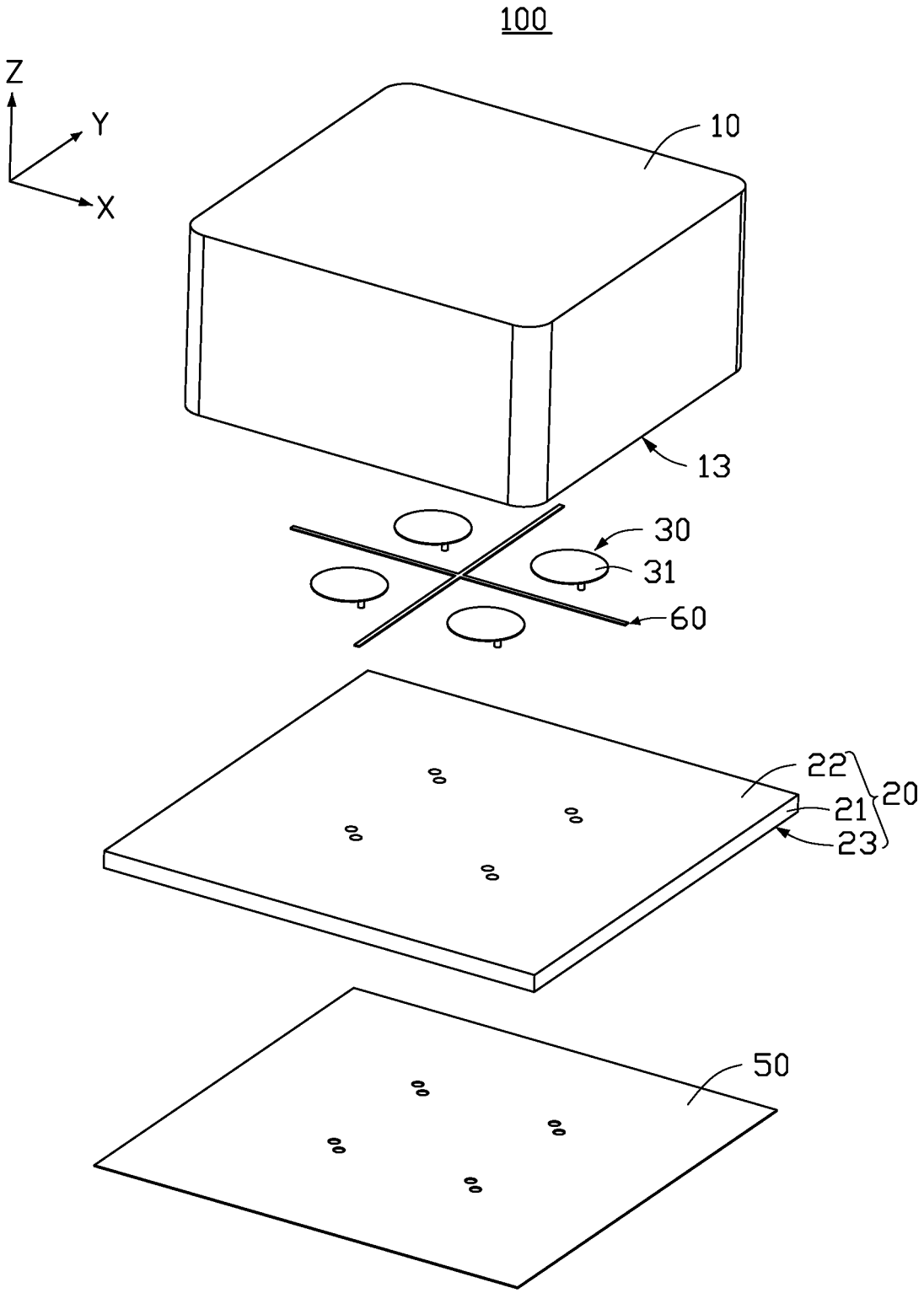
FIG. 2 is a isometric view of the antenna structure of FIG. 1.
Figure 3:
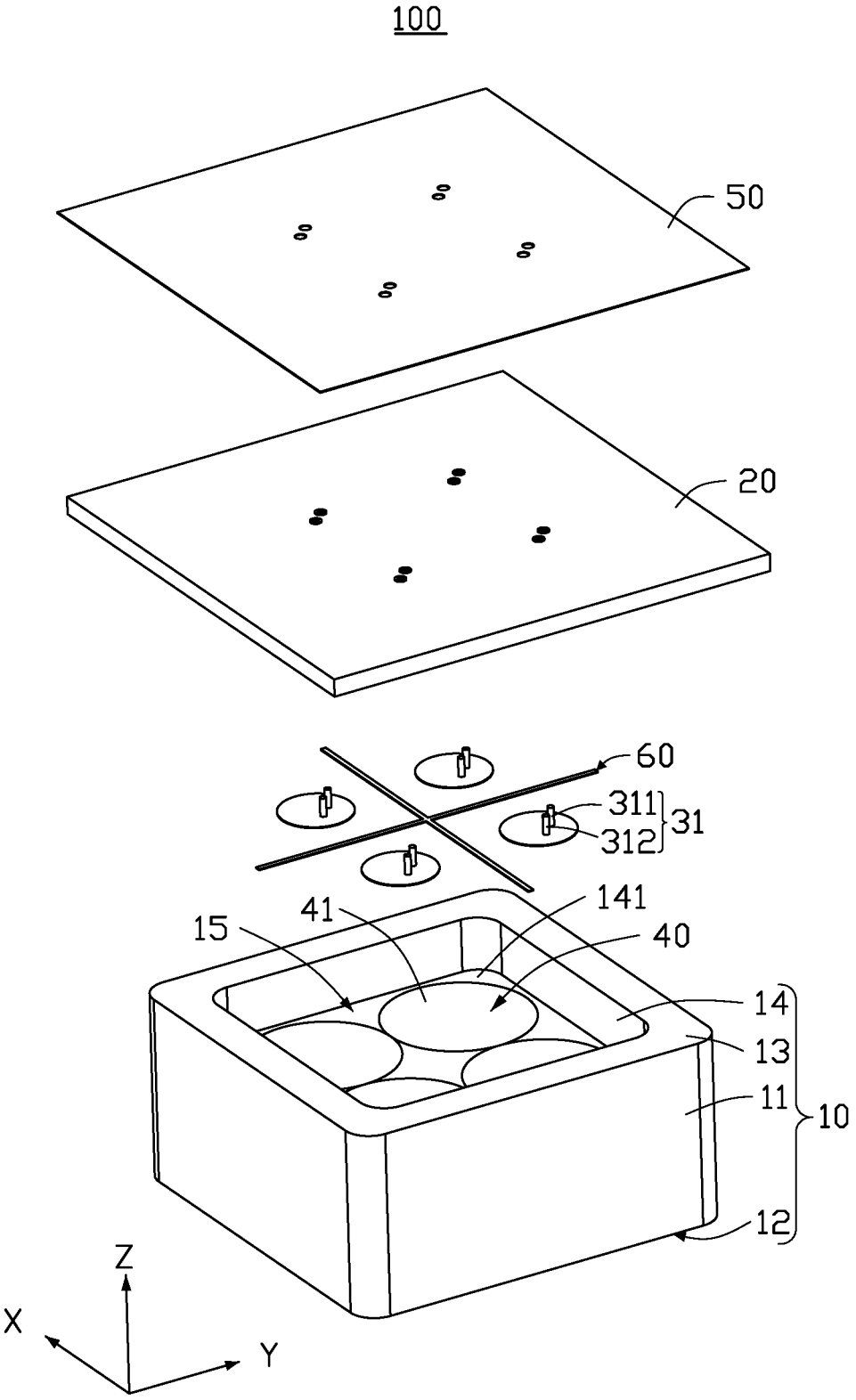
FIG. 3 is similar to FIG. 2, but from another aspect.

Referring to FIGS. 2 and 3, the antenna structure 100 can include a main body 10, a substrate 20, an array antenna 30, a lens array 40, and a grounding plate 50.

The main body 10 is made of materials which have a dielectric constant of 3 to 4. For example, the main body 10 is made of polyphenylene ether (PPE) plastic which has a dielectric constant of 3. In an embodiment, the main body 10 is substantially a cubic structure having an opening. The main body 10 includes a first side wall 11, an upper surface 12, and a bottom surface 13 opposite to the upper surface 12. The first side wall 11 connects the upper surface 12 and the bottom surface 13. The bottom surface 13 is recessed to form a receiving space 15, having an inner surface 14. The receiving space 15 is configured for receiving an array of antennas (array antenna 30). The main body 10 can be a protective shell enclosing the array antenna 30. The main body 10 covers the substrate 20 with the array antenna 30 being received in the receiving space 15.

The substrate 20 can be a printed circuit board (PCB). The substrate 20 can be made of dielectric materials such as epoxy glass fiber (FR4). The substrate 20 is positioned at an end of the main body 10 and adjacent to the bottom surface 13.

In this embodiment, the substrate 20 is substantially a rectangular plate. The substrate 20 includes a side wall 21, a first surface 22, and a second surface 23 opposite to the first surface 22. The second side wall 21 connects the first surface 22 and the second surface 23. In this embodiment, the second side wall 21 is substantially perpendicularly connected between the first surface 22 and the second surface 23. In this embodiment, the first surface 22 is adjacent to the bottom surface 13.

Figure 4:
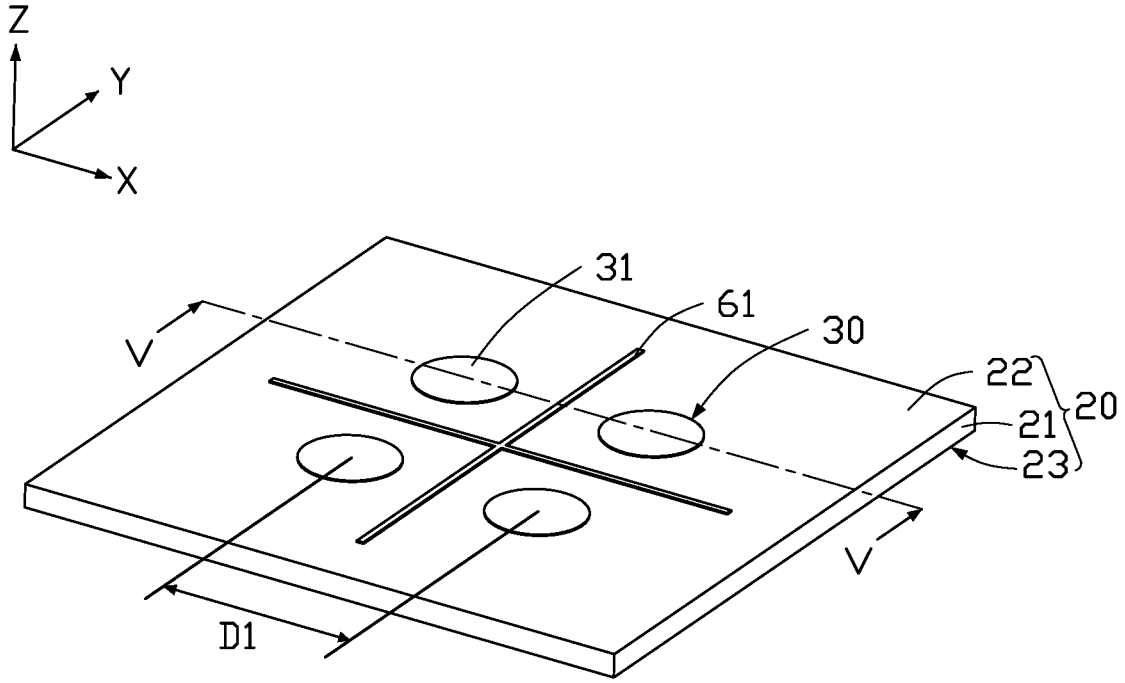
FIG. 4 is a view of part of the antenna structure of FIG. 1.

Referring to FIG. 4, in an embodiment, the array antenna 30 is positioned on the first surface 22. The array antenna 30 is made of metallic materials. For example, the array antenna 30 can be made of pieces of copper foil.

In an embodiment, the array antenna 30 includes N*N antenna units 31, wherein N is a positive integer greater than 1. The N*N antenna units 31 are arranged as N rows of antenna units 31 and N columns of antenna units 31. The N rows of antenna units 31 are arranged in a first direction, such as an X-axis direction. The N columns of antenna units 31 are arranged in a second direction, such as a Y-axis direction. Thus, each antenna unit 31 is positioned in an X-Y plane. Each antenna unit 31 has the same shape and size. In this embodiment, each antenna unit 31 is substantially circular. A distance D1 between center points of adjacent antenna units 31 is about $0.45\times\lambda$–$0.6\times\lambda$, wherein $\lambda$ is a wavelength of electromagnetic waves which can be transmitted or received by the antenna structure 100 in the air. In this embodiment, $\lambda$ is a relatively stable value.

Referring to FIG. 4, in this embodiment, N is equal to 2, the array antenna 30 includes 2*2 antenna units 31.

Figure 5:
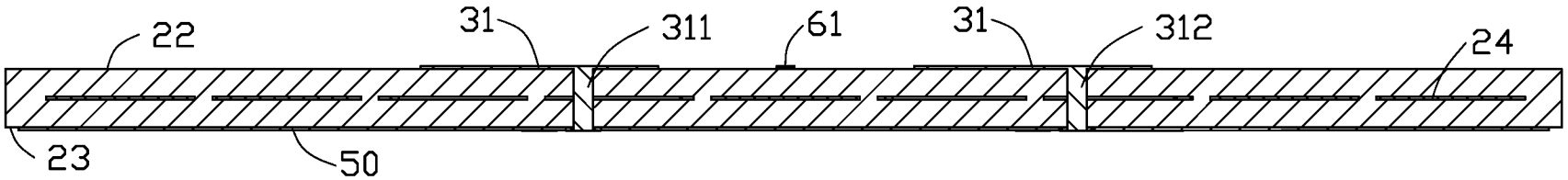
FIG. 5 is a cross-section view along line V-V of FIG. 4.

Also referring to FIGS. 3 and 5, each antenna unit 31 includes a first feeding portion 311 and a second feeding portion 312. In this embodiment, the first feeding portion 311 and the second feeding portion 312 are metallic posts. An end of each first feeding portion 311 is connected to the antenna unit 31. Another end of each first feeding portion 311 is electrically connected to a first feeding source (not shown). An end of the second feeding portion 312 is connected to each antenna unit 31. Another end of each second feeding portion 312 is electrically connected to a second feeding source (not shown). The first feeding portion 311 and the second feeding portion 312 are configured for feeding current for each antenna unit 31.

In this embodiment, the first feeding source and the second feeding source are positioned at the ground plate 50. In other embodiment, the first feeding source and the second feeding source can also be positioned at the second surface 23.

When each first feeding portion 311 supplies current, the current flows through each antenna unit 31 to activate each antenna unit 31 to generate electromagnetic waves of a first polarization direction. When each second feeding portion 312 supplies current, the current flows to each antenna unit 31 to activate each antenna unit 31 to generate electromagnetic waves of a second polarization direction. The first polarization direction and the second polarization direction are perpendicular to each other. In this embodiment, the first polarization direction is a horizontal polarization, and the second polarization direction is a vertical polarization. The horizontal polarization can be an X-Y plane polarization, and the vertical polarization can be a Z-axis polarization. In other embodiments, the first polarization direction and the second polarization direction can be other directions.

Figure 6:
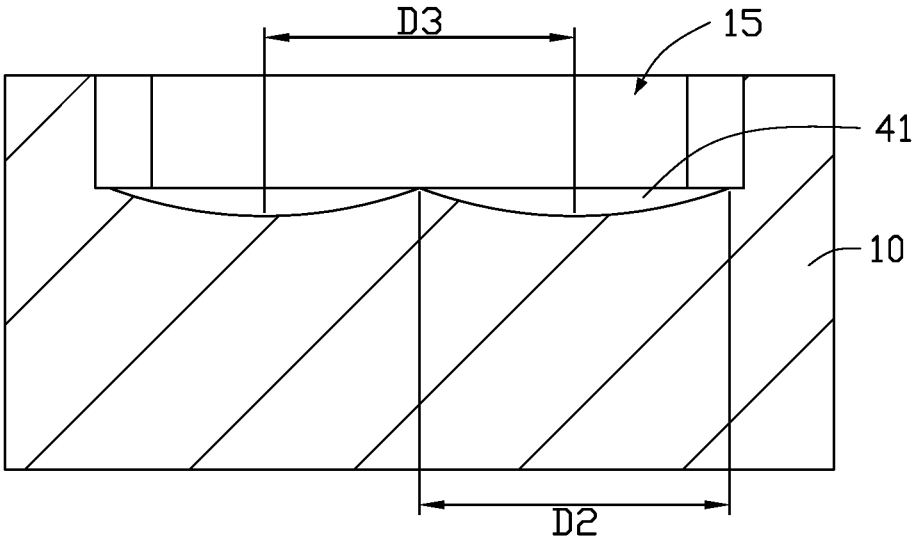
FIG. 6 is a cross-section view of a main body of the antenna structure of FIG. 1.

Referring to FIG. 3 and FIG. 6, in this embodiment, the lens array 40 includes N*N lens units 41. The N*N lens units 41 are arranged as N rows of lens units 41 and N columns of lens units 41. The N rows of lens units 41 are arranged in the first direction, such as the X-axis direction. The N columns of lens units 41 are arranged in the second direction, such as the Y-axis direction. The lens array 40 is spaced apart from and parallel to the array antenna 30. Each lens unit 41 has the same shape and size. In this embodiment, each lens unit 41 is substantially circular. A diameter D2 of each lens unit 41 is about 0.45×λ to 0.6×λ. A distance between edges of adjacent lens units 41 is zero. Thus, a distance D3 between center points of every two adjacent lens units 41 is about 0.45×λ to 0.6×λ. In this embodiment, D2 is equal to D3. Thus, the diameter of each lens unit 41 is equal to the distance between the center points of adjacent lens units 41.

In this embodiment, the number of the N*N lens units 41 is the same as the number of the N*N antenna units 31. Each lens unit 41 is positioned above an antenna unit 31. The center point of each lens unit 41 is positioned above the center point of an antenna unit 31. Each lens unit 41 is concentric with the antenna unit 31 and covers the antenna unit 31. Thus, D1 is equal to D3. The distance between the center points of adjacent lens units 41 is equal to distance between the center points of adjacent antenna units 31. Each lens unit 41 concentrates a beam of radio waves emitted by the antenna unit 31.

In this embodiment, each lens unit 41 is a cavity formed on the inner surface 14. A lens function is achieved by a curved surface 141 of the main body 10 thereby forming a lens function.

In this embodiment, as shown in FIG. 3, N is equal to 2, and the lens array 40 includes 2*2 lens units 41.

FIG. 5 is a cross-sectional view of the antenna structure 100 of FIG. 4 taken along line V-V. In this embodiment, a high-impedance surface (HIS) layer 24 is embedded into the substrate 20. The HIS layer 24 is a sequence of square structures. The HIS layer 24 includes a plurality of spaced square cells 241. Each square unit 241 can be made of metal. A length L of each side of a square cell 241 is about 0.25×λ1 to 0.5×λ1. λ1 is a wavelength of electromagnetic waves which are to be transmitted or received by the antenna structure 100, transmitted into the substrate 20. In this embodiment, λ1 is a relatively stable value. λ1 is smaller than λ. Each square cell 241 suppresses surface waves generated by the lens arrays 40 and the substrate 20 to increase a gain of the antenna structure 100.

Figure 7:
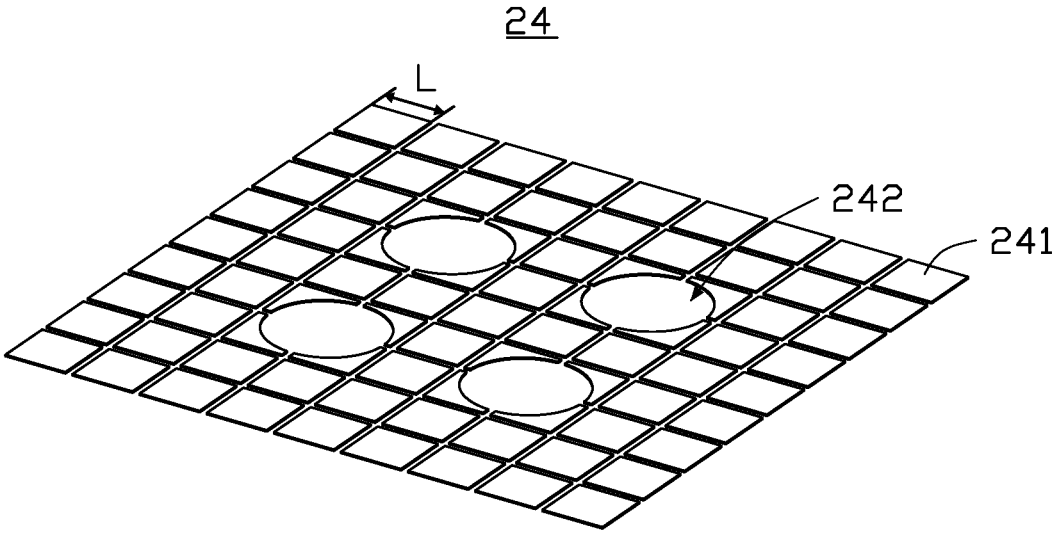
FIG. 7 is a schematic view of a high-impedance surface (HIS) layer of the antenna structure of FIG. 1.

Referring FIG. 7, in this embodiment, the HIS layer 24 defines N*N holes 242. The number of the holes 242 and of the antenna units 31 is same. Each hole 242 is defined in the HIS layers 24 to correspond to each antenna unit 31. Each hole 31 is concentric with an antenna unit 31. Thus, a center point of each hole 242 is positioned below the center point of an antenna unit 31. Each hole 242 has the same radius, and radius of each antenna unit 31 is also constant. The radius of each circular hole 242 is about 0.1 mm to 0.2 mm greater than the radius of each antenna unit 31. The holes 242 improve isolation of cross polarization between the antenna units 31.

Referring to FIG. 2 again, in this embodiment, the grounding plate 50 is positioned adjacent to the second surface 23. The grounding plate 50 can include a grounding surface (not shown) configured for grounding the antenna structure 100. In an embodiment, the grounding plane is insulated from the first feeding source and the second feeding source.

In this embodiment, the antenna structure 100 further includes a metal mesh 60 (see FIGS. 2-4). The metal mesh 60 is positioned on the first surface 22 and positioned between the antenna units 31. The metal mesh 60 includes a plurality of metal strips 61. Each metal strip 61 is positioned between two rows of the antenna units 31 or two columns of the antenna units 31 and is coplanar with the antenna units 31. The metal strips 61 reduce interference between the antenna units 31. In this embodiment, the metal mesh 60 can include two or more metal strips 61.

In other embodiments, a number of the metal strips 61 can depend on the number of the antenna units 31. If the array antenna 30 includes N*N of the antenna units 31, the metal mesh 60 includes 2*(N−1) of the metal strips 61. Each metal strip 61 is positioned between adjacent rows of the antenna units 31. Each metal strip 61 is also positioned between adjacent columns of the antenna units 31.

Figure 8:
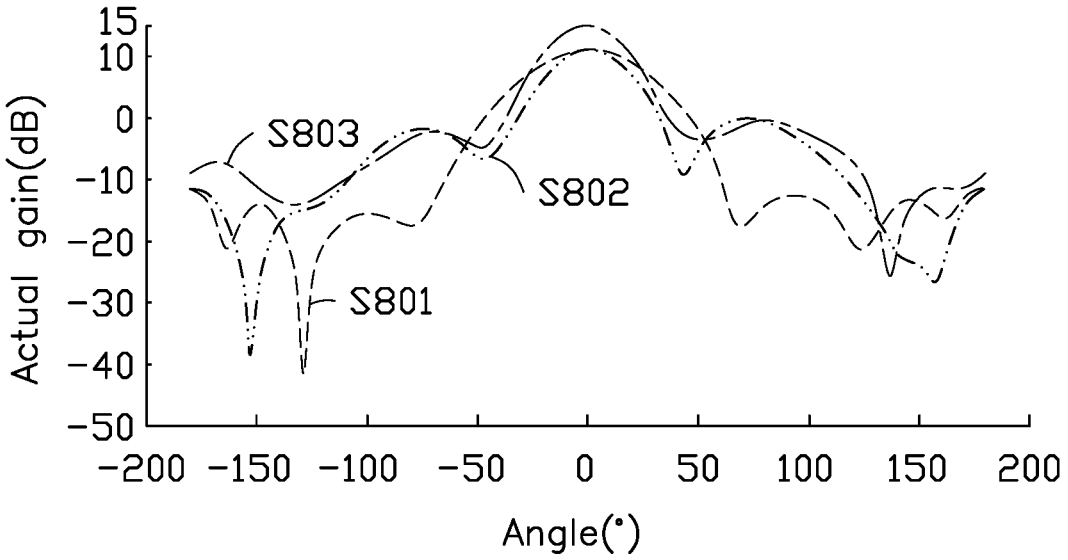
FIG. 8 shows an actual gain graph of the antenna structure of FIG. 1.

FIG. 8 shows a graph of an actual gain of the antenna structure 100 on a circumference centered on the antenna structure 100. The vertical axis of FIG. 8 corresponds to the actual gain of the antenna structure 100, and the horizontal axis of FIG. 8 corresponds to an angle on the circumference. The angle of 0 degrees is a main radiating direction of the antenna structure 100. Curve S801 represents an actual gain of an antenna structure 100 which does not have lens array 40 or the HIS layer 24. Curve S802 represents an actual gain of an antenna structure 100 which has the lens array 40 but not the HIS layer 24. Curve S803 represents an actual gain of the antenna structure 100 which has both the lens array 40 and the HIS layer 24. As shown in FIG. 8, radiating energy of the antenna structure 100 combined with the lens array 40 has more convergence, but the gain of the antenna structure 100 at the main radiation direction is not significantly increased. The gain of the antenna structure 100 at the main radiation direction is significantly increased after the addition of the lens array 40 coupled with the HIS layer 24.

The antenna structure 100 increases the gain of the array antenna 30 and concentrates beams radio waves of the array antenna 30 by arranging the lens array 40 above the array antenna 30 and embedding the HIS layer 24 in the substrate 20.

The embodiments shown and described above are only examples. Many details are often found in the art such as the other features of the antenna structure and the wireless communication device. Therefore, many such details are neither shown nor described. Even though numerous characteristics and advantages of the present disclosure have been set forth in the foregoing description, together with details of the structure and function of the present disclosure, the disclosure is illustrative only, and changes may be made in the details, especially in matters of shape, size, and arrangement of the parts within the principles of the present disclosure, up to and including the full extent established by the broad general meaning of the terms used in the claims. It will therefore be appreciated that the embodiments described above may be modified within the scope of the claims.

What is claimed is:

1. An antenna structure comprising:

a substrate comprising a first surface and a second surface opposite to the first surface;

an array antenna positioned on the first surface, the array antenna comprising a plurality of antenna units;

a main body covering the substrate and receiving the array antenna therein;

a lens array comprising a plurality of lens units corresponding to the plurality of antenna units, the lens units being configured to concentrate beams generated by the antenna units;

a grounding plate positioned at the second surface and configured to ground the array antenna; and a high-impedance surface (HIS) layer embedded into the substrate, the HIS layer being configured to suppress surface waves generated by the lens arrays and the substrate to increase a gain of the antenna structure;

wherein the HIS layer comprises a plurality of circular holes, each circular hole having same radius, and each antenna unit having same radius, the radius of each circular hole being greater than the radius of each antenna unit.

2. The antenna structure of claim 1, wherein the main body is made of materials which have a dielectric constant of 3 to 4.

3. The antenna structure of claim 1, wherein each of the plurality of antenna units comprises a first feeding portion and a second feeding portion configured to feed current to each a corresponding one of the antenna units thereby activating each of the antenna units to generate electromagnetic waves of a horizontal polarization and a vertical polarization.

4. The antenna structure of claim 1, wherein each of the antenna units has a substantially circular shape and a same size, and each of the lens units has a substantially circular shape and a same size, each of the lens units is concentric with the corresponding one of the antenna units and covers the corresponding antenna unit.

5. The antenna structure of claim 1, wherein each of the lens units is a cavity formed on a curved surface of the main body thereby forming a lens function.

6. The antenna structure of claim 1, wherein the HIS layer is a periodic square structure, the HIS layer comprises a plurality of spaced square cells, a length of each side of each of the square cells is approximately $0.25\times\lambda 1$ to $0.5\times\lambda 1$ wherein $\lambda 1$ is a wavelength of electromagnetic waves to be transmitted or have been received by the antenna structure transmitted in the substrate.

7. The antenna structure of claim 1, wherein the plurality of circular holes correspond to the plurality of antenna units, each of the plurality of circular holes is concentric with the corresponding antenna unit.

8. The antenna structure of claim 7, wherein a distance between center points of adjacent antenna units is approximately $0.45\times\lambda$ to $0.6\times\lambda$, a diameter of each of the lens units is approximately $0.45\times\lambda$ to $0.6\times\lambda$, wherein $\lambda$ is a wavelength of electromagnetic waves which can be transmitted or received by the antenna structure.

9. The antenna structure of claim 1, further comprising a metal mesh, wherein the metal mesh comprises a plurality of metal strips, each of the metal strips is positioned between adjacent rows of the antenna units or adjacent columns of the antenna units and is coplanar with the antenna units, the metal strips are configured to reduce interference between the antenna units.

10. A wireless communication device comprising:

an antenna structure comprising:

a substrate comprising a first surface and a second surface opposite to the first surface;

an array antenna positioned on the first surface, the array antenna comprising a plurality of antenna units;

a main body covering the substrate and receiving the array antenna therein;

a lens array comprising a plurality of lens units corresponding to the plurality of antenna units, the lens units being configured to concentrate beams generated by the antenna units;

a grounding plate positioned at the second surface and configured to ground the array antenna; and a high-impedance surface (HIS) layer embedded into the substrate, the HIS layer being configured to suppress surface waves generated by the lens arrays and the substrate to increase a gain of the antenna structure;

wherein the HIS layer comprises a plurality of circular holes, each circular hole has a same radius, each antenna unit has a same radius, the radius of each circular hole being greater than the radius of each antenna unit; and wherein each of the antenna units has a substantially circular shape and a same size.

11. The wireless communication device of claim 10, wherein the main body is made of materials which have a dielectric constant of 3 to 4.

12. The wireless communication device of claim 10, wherein each of the plurality of antenna units comprises a first feeding portion and a second feeding portion configured to feed current to each a corresponding one of the antenna units thereby activating each of the antenna units to generate electromagnetic waves of a horizontal polarization and a vertical polarization.

13. The wireless communication device of claim 10, wherein each of the lens units has a substantially circular shape and a same size, each of the lens units is concentric with the corresponding one of the antenna units and covers the corresponding antenna unit.

14. The wireless communication device of claim 10, wherein each of the lens units is a cavity formed on a curved surface of the main body thereby forming a lens function.

15. The wireless communication device of claim 10, wherein the HIS layer is a periodic square structure, the HIS layer comprises a plurality of spaced square cells, a length of each side of each of the square cells is approximately $0.25\times\lambda\mathbf{1}$ to $0.5\times\lambda\mathbf{1}$, wherein $\lambda\mathbf{1}$ is a wavelength of electromagnetic waves to be transmitted or have been received by the antenna structure transmitted in the substrate.

16. The wireless communication device of claim 10, wherein the plurality of circular holes correspond to the plurality of antenna units, each of the plurality of circular holes is concentric with the corresponding antenna unit.

17. The wireless communication device of claim 16, wherein a distance between center points of adjacent antenna units is approximately $0.45\times\lambda$ to $0.6\times\lambda$, a diameter of each of the lens units is approximately $0.45\times\lambda$ to $0.6\times\lambda$, wherein $\lambda$ is a wavelength of electromagnetic waves which can be transmitted or received by the antenna structure.

18. The wireless communication device of claim 10, wherein the antenna structure further comprises a metal mesh, the metal mesh comprises a plurality of metal strips, each of the metal strips is positioned between adjacent rows of the antenna units or adjacent columns of the antenna units and is coplanar with the antenna units, the metal strips are configured to reduce interference between the antenna units.

* * * * *